US011647344B2

(12) United States Patent
Chen et al.

(10) Patent No.: US 11,647,344 B2
(45) Date of Patent: May 9, 2023

(54) HEARING DEVICE WITH END-TO-END NEURAL NETWORK

(71) Applicant: British Cayman Islands Intelligo Technology Inc., Grand Cayman (KY)

(72) Inventors: Ting-Yao Chen, Zhubei (TW); Chen-Chu Hsu, Zhubei (TW); Yao-Chun Liu, Zhubei (TW); Tsung-Liang Chen, Zhubei (TW)

(73) Assignee: BRITISH CAYMAN ISLANDS INTELLIGO TECHNOLOGY INC., Grand Cayman (KY)

( * ) Notice: Subject to any disclaimer, the term of this patent is extended or adjusted under 35 U.S.C. 154(b) by 0 days.

(21) Appl. No.: 17/592,006

(22) Filed: Feb. 3, 2022

(65) Prior Publication Data

US 2022/0329953 A1 Oct. 13, 2022

Related U.S. Application Data

(60) Provisional application No. 63/171,592, filed on Apr. 7, 2021.

(51) Int. Cl.
*H04R 25/00* (2006.01)
*H04R 1/10* (2006.01)

(52) U.S. Cl.
CPC ..... *H04R 25/507* (2013.01); *H04R 1/1083* (2013.01); *H04R 25/353* (2013.01)

(58) Field of Classification Search
CPC ..... H04R 25/507; H04R 2460/01
(Continued)

(56) References Cited

U.S. PATENT DOCUMENTS 8,229,127 B2 7/2012 Jørgensen et al.
10,542,354 B2 1/2020 Tiefenau et al.
(Continued)

FOREIGN PATENT DOCUMENTS

CN 111584065 A 8/2020
CN 111584065 A 8/2020
(Continued)

OTHER PUBLICATIONS

Wayne Staab, "Hearing Aid Delay," https://hearinghealthmatters.org/waynesworld/2016/hearingaid-delay/, dated Jan. 19, 2016, 7 pages.
(Continued)

*Primary Examiner* — Katherine A Faley
(74) *Attorney, Agent, or Firm* — Muncy, Geissler, Olds & Lowe, P.C.

(57) ABSTRACT

A hearing device is disclosed, comprising a main microphone, M auxiliary microphones, a transform circuit, a processor, a memory and a post-processing circuit. The transform circuit transforms first sample values in current frames of a main audio signal and M auxiliary audio signals from the microphones into a main and M auxiliary spectral representations. The memory includes instructions to be executed by the processor to perform operations comprising: performing ANC over the first sample values using an end-to-end neural network to generate second sample values; and, performing audio signal processing over the main and the M auxiliary spectral representations using the end-to-end neural network to generate a compensation mask. The post-processing circuit modifies the main spectral representation with the compensation mask to generate a compensated spectral representation, and generates an output audio signal according to the second sample values and the compensated spectral representation.

20 Claims, 5 Drawing Sheets

(58) Field of Classification Search
USPC ..... 381/312, 317
See application file for complete search history.

(56) References Cited

U.S. PATENT DOCUMENTS

| | | | | |
|---|---|---|---|---|
| 10,805,740 | B1 * | 10/2020 | Snyder | H04R 25/407 |
| 2006/0182295 | A1 * | 8/2006 | Dijkstra | H04R 25/43 381/315 |
| 2007/0269066 | A1 * | 11/2007 | Derleth | H04R 25/502 381/316 |
| 2014/0177857 | A1 * | 6/2014 | Kuster | H04R 25/407 381/66 |
| 2014/0270290 | A1 * | 9/2014 | Cheung | H04R 25/405 381/316 |
| 2020/0221236 | A1 | 7/2020 | Jensen et al. | |
| 2021/0125625 | A1 * | 4/2021 | Huang | G10L 25/21 |
| 2022/0044696 | A1 * | 2/2022 | Kim | G06N 3/045 |

FOREIGN PATENT DOCUMENTS

| | | | |
|---|---|---|---|
| CN | 111916101 | A | 11/2020 |
| CN | 111916101 | A | 11/2020 |

OTHER PUBLICATIONS

Laura Winther Balling et al., "Reducing hearing aid delay for optimal sound quality: a new paradigm in processing", https://www.hearingreview.com/hearingproducts/hearing-aids/bte/reducing-hearing-aid-delay-for-optimalsound-quality-a-new-paradigm-in-processing, dated Apr. 23, 2020, 11 pages.

Erdogan, H, "Improved MVDR beamforming using single-channel mask prediction networks" Mitsubishi Electric Research Laboratories, Sep. 2016, 7 pages.

Hao Zhang, Deliang Wang, "A Deep Learning Approach to Active Noise Control", Interspeech Oct. 25, 2020, Computer Science, pp. 1141-1145.

Erdogan et al., "Improved MVDR beamforming using single-channel mask prediction networks," Mitsubishi Electric Research Laboratories, Sep. 2016, 6 pages.

Zhang et al., "A Deep Learning Approach to Active Noise Control," Interspeech 2000, Oct. 25-29, 2020, 5 pages.

* cited by examiner

42k

HEARING DEVICE WITH END-TO-END NEURAL NETWORK

CROSS-REFERENCE TO RELATED APPLICATION

This application claims priority under 35 USC 119(e) to U.S. provisional application No. 63/171,592, filed on Apr. 7, 2021, the content of which is incorporated herein by reference in its entirety.

BACKGROUND OF THE INVENTION

Field of the Invention

The invention relates to hearing devices, and more particularly, to a hearing device with an end-to-end neural network for reducing comb-filtering effect by performing active noise cancellation and audio signal processing.

Description of the Related Art

It is hard for people to adjust to hearing aids. The fact is that no matter how good a hearing aid is, it always sounds like a hearing aid. A significant cause of this is the "comb-filter effect," which arises because the digital signal processing in the hearing aid delays the amplified sound relative to the leak-path/direct sound that enters the ear through venting in the ear tip and any leakage around it. The delay is the time that the hearing aid takes to (1) sample and convert an analog audio signal into a digital audio signal; (2) perform digital signal processing; (3) convert the processed signal into an analog audio signal to be delivered to the hearing aid speaker. Prior experiments showed even a delay of around 2 milliseconds (ms) results in clear comb-filtering effect, while ultralow delay below 0.5 ms does not. This delay is perceived as echoes or reverberation by the person wearing a hearing aid and listening to the environmental sounds such as speeches and background noises. The comb-filter effect significantly reduces the sound quality.

As well known in the art, the sound through the leak path (i.e., direct sound) can be removed by introducing Active Noise Cancellation (ANC). After the direct sound is cancelled, the comb-filter effect would be mitigated. US Pub. No. 2020/0221236A1 disclosed a hearing device with an additional ANC circuit for cancelling the sound through the leak path. Theoretically, the ANC circuit may operate in time domain or frequency domain. Normally, the ANC circuit in the hearing aid includes one or more time-domain filters because the signal processing delay of the ANC circuit is typically required to be less than 50 μs. For the ANC circuit operating in frequency domain, the short-time Fourier Transform (STFT) and the inverse STFT processes contribute the signal processing delays ranging from 5 to 50 milliseconds (ms), which includes the effect of ANC circuit. However, most state-of-the-art audio algorithms manipulate audio signals in frequency domain for advanced audio signal processing.

What is needed is a hearing device for integrating time-domain and frequency-domain audio signal processing, reducing comb-filtering effect, performing ANC and advanced audio signal processing, and improving audio quality.

SUMMARY OF THE INVENTION

In view of the above-mentioned problems, an object of the invention is to provide a hearing device capable of integrating time-domain and frequency-domain audio signal processing and improving audio quality.

One embodiment of the invention provides a hearing device. The hearing device comprises a main microphone, M auxiliary microphones, a transform circuit, at least one processor, at least one storage media and a post-processing circuit. The main microphone and M auxiliary microphones respectively generate a main audio signal and M auxiliary audio signals. The transform circuit respectively transforms multiple first sample values in current frames of the main audio signal and the M auxiliary audio signals into a main spectral representation and M auxiliary spectral representations. The at least one memory including instructions operable to be executed by the at least one processor to perform a set of operations comprising: performing active noise cancellation (ANC) operations over the first sample values using an end-to-end neural network to generate multiple second sample values; and, performing audio signal processing operations over the main spectral representation and the M auxiliary spectral representations using the end-to-end neural network to generate a compensation mask. The post-processing circuit modifies the main spectral representation with the compensation mask to generate a compensated spectral representation, and generates an output audio signal according to the second sample values and the compensated spectral representation, where M>=0.

Another embodiment of the invention provides an audio processing method applicable to a hearing device. The audio processing method comprises: providing a main audio signal by a main microphone and M auxiliary audio signals by M auxiliary microphones, where M>=0; respectively transforming first sample values in current frames of the main audio signal and the M auxiliary audio signals into a main spectral representation and M auxiliary spectral representations; performing active noise cancellation (ANC) operations over the first sample values using an end-to-end neural network to obtain multiple second sample values; performing audio signal processing operations over the main spectral representation and the M auxiliary spectral representations using the end-to-end neural network to obtain a compensation mask; modifying the main spectral representation with the compensation mask to obtain a compensated spectral representation; and, obtaining an output audio signal according to the second sample values and the compensated spectral representation.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
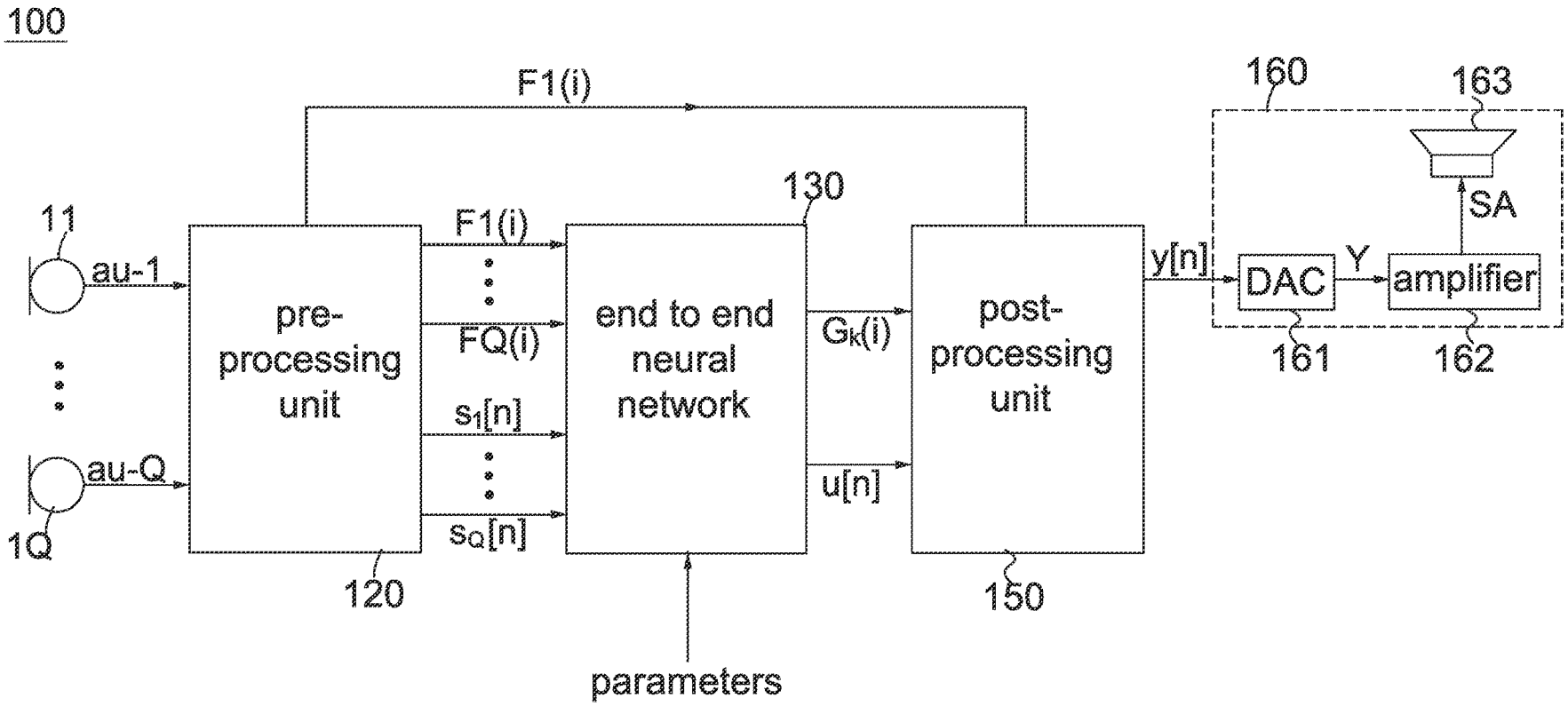
FIG. 1 is a schematic diagram of a hearing device according to the invention.

As used herein and in the claims, the term "and/or" includes any and all combinations of one or more of the associated listed items. The use of the terms "a" and "an" and "the" and similar referents in the context of describing the invention are to be construed to cover both the singular and the plural, unless otherwise indicated herein or clearly contradicted by context. Throughout the specification, the same components with the same function are designated with the same reference numerals.

A feature of the invention is to use an end-to-end neural network to simultaneously perform ANC function and advanced audio signal processing, e.g., noise suppression, acoustic feedback cancellation (AFC) and sound amplification and so on. Another feature of the invention is that the end-to-end neural network receives a time-domain audio signal and a frequency-domain audio signal for each microphone so as to gain the benefits of both time-domain signal processing (e.g., extremely low system latency) and frequency-domain signal processing (e.g., better frequency analysis). In comparison with the conventional ANC technology that is most effective on lower frequencies of sound, e.g., between 50 to 1000 Hz, the end-to-end neural network of the invention can reduce both the high-frequency noise and low-frequency noise.

FIG. 1 is a schematic diagram of a hearing device according to the invention. Referring to FIG. 1, the hearing device 100 of the invention includes a number Q of microphones 11~1Q, a pre-processing unit 120, an end-to-end neural network 130, a post-processing unit 150 and an output circuit 160, where Q>=1. The hearing device 100 may be a hearing aid, e.g. of the behind-the-ear (BTE) type, in-the-ear (ITE) type, in-the-canal (ITC) type, or completely-in-the-canal (CIC) type.

A main microphone 11, located outside the ear, is used to collect ambient sound to generate a main audio signal au-1. If Q>1, at least one auxiliary microphone 12~1Q generates at least one auxiliary audio signal au-2~au-Q. The pre-processing unit 120 is configured to receive Q audio signals au-1~au-Q and generate audio data of current frames i of Q time-domain digital audio signals $s_1[n]$~$s_Q[n]$ and Q current spectral representations F1(*i*)~FQ(i) corresponding to the audio data of the current frames i of time-domain digital audio signals $s_1[n]$~$s_Q[n]$, where n denotes the discrete time index and i denotes the frame index of the time-domain digital audio signals $s_1[n]$~$s_Q[n]$. The end-to-end neural network 130 receives input parameters, the Q current spectral representations F1(*i*)~FQ(i) and audio data for current frames i of the Q time-domain signals $s_1[n]$~$s_Q[n]$, performs ANC and AFC functions, noise suppression and sound amplification to generate a frequency-domain compensation mask stream $G_1(i)$~$G_N(i)$ and audio data of the current frame i of a time-domain digital data stream u[n]. The post-processing unit 150 receives the frequency-domain compensation mask stream $G_1(i)$~$G_N(i)$ and audio data of the current frame i of the time-domain data stream u[n] to generate audio data for the current frame i of a time-domain digital audio signal y[n], where N denotes the Fast Fourier transform (FFT) size. Finally, the output circuit 160 converts the digital audio signal y[n] into a sound pressure signal in an ear canal of the user. The output circuit 160 includes a digital to analog converter (DAC)161, an amplifier 162 and a loudspeaker 163.

Figure 2:
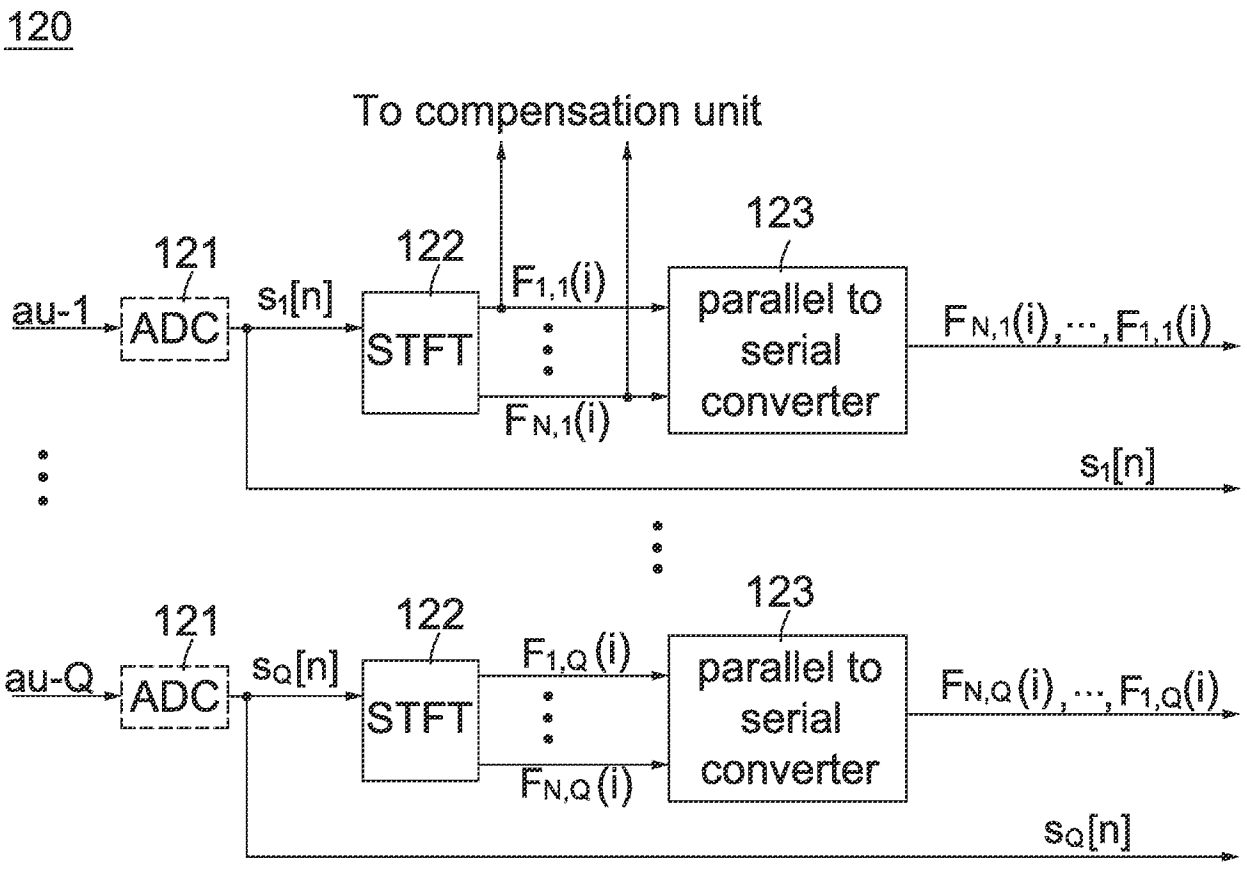
FIG. 2 is a schematic diagram of the pre-processing unit 120 according to an embodiment of the invention.

FIG. 2 is a schematic diagram of the pre-processing unit 120 according to an embodiment of the invention. Referring to FIG. 2, if the outputs of the Q microphones 11~1Q are analog audio signals, the pre-processing unit 120 includes Q analog-to-digital converters (ADC) 121, Q STFT blocks 122 and Q parallel-to-serial converters (PSC) 123; if the outputs of the Q microphones 11~1Q are digital audio signals, the pre-processing unit 120 only includes Q STFT blocks 122 and Q PSC 123. Thus, the ADCs 121 are optional and represented by dash lines in FIG. 2. The ADCs 121 respectively convert Q analog audio signals (au-1~au-Q) into Q digital audio signals ($s_1[n]$~$s_Q[n]$). In each STFT block 122, the digital audio signal $s_j[n]$ is firstly broken up into frames using a sliding widow along the time axis so that the frames overlap each other to reduce artifacts at the boundary, and then, the audio data in each frame in time domain is transformed by FFT into complex-valued data in frequency domain. Assuming a number of sampling points in each frame (or the FFT size) is N, the time duration for each frame is Td and the frames overlap each other by Td/2, each STFT block 122 divides the audio signal $s_j[n]$ into a plurality of frames and computes the FFT of audio data in the current frame i of a corresponding audio signal $s_j[n]$ to generate a current spectral representation Fj(i) having N complex-valued samples ($F_{1,j}(i)$~$F_{N,j}(i)$) with a frequency resolution of fs/N(=1/Td), where 1<=j<=Q. Here, fs denotes a sampling frequency of the digital audio signal $s_j[n]$ and each frame corresponds to a different time interval of the digital audio signal $s_j[n]$. In a preferred embodiment, the time duration Td of each frame is about 32 milliseconds (ms). However, the above time duration Td is provided by way of example and not limitation of the invention. In actual implementations, other time duration Td may be used. Finally, each PSC 123 converts the corresponding N parallel complex-valued samples ($F_{1,j}(i)$~$F_{N,j}(i)$) into a serial sample stream, starting from $F_{1,j}(i)$ and ending with $F_{N,j}(i)$. Please note that the 2*Q data streams F1(*i*)~FQ(i) and $s_1[n]$~$s_Q[n]$ outputted from the pre-processing unit 120 are synchronized so that 2*Q elements in each column (e.g., $F_{1,1}(i)$, $s_1[1]$, . . . , $F_{1,Q}(i)$, $s_Q[1]$ in one column) from the 2*Q data streams F1(*i*)~FQ(i) and $s_1[n]$~$s_Q[n]$ are aligned with each other and sent to the end-to-end neural network 130 at the same time.

The pre-processing unit 120, the end-to-end neural network 130 and the post-processing unit 150 may be implemented by software, hardware, firmware, or a combination thereof. In one embodiment, the pre-processing unit 120, the end-to-end neural network 130 and the post-processing unit 150 are implemented by at least one processor and at least one storage media (not shown). The at least one storage media stores instructions/program codes operable to be executed by the at least one processor to cause the processor to function as: the pre-processing unit 120, the end-to-end neural network 130 and the post-processing unit 150. In an alternative embodiment, only the end-to-end neural network 130 is implemented by at least one processor and at least one storage media (not shown). The at least one storage media stores instructions/program codes operable to be executed by the at least one processor to cause the at least one processor to function as: the end-to-end neural network 130.

The end-to-end neural network 130 may be implemented by a deep neural network (DNN), a convolutional neural network (CNN), a recurrent neural network (RNN), a time delay neural network (TDNN) or any combination thereof. Various machine learning techniques associated with supervised learning may be used to train a model of the end-to-end neural network 130 (hereinafter called "model 130" for short). Example supervised learning techniques to train the end-to-end neural network 130 include, without limitation, stochastic gradient descent (SGD). In supervised learning, a function $f$ (i.e., the model 130) is created by using four sets of labeled training examples (will be described below), each of which consists of an input feature vector and a labeled output. The end-to-end neural network 130 is configured to use the four sets of labeled training examples to learn or estimate the function $f$ (i.e., the model 130), and then to update model weights using the backpropagation algorithm in combination with cost function. Backpropagation iteratively computes the gradient of cost function relative to each weight and bias, then updates the weights and biases in the opposite direction of the gradient, to find a local minimum. The goal of a learning in the end-to-end neural network 130 is to minimize the cost function given the four sets of labeled training examples.

Figure 3:
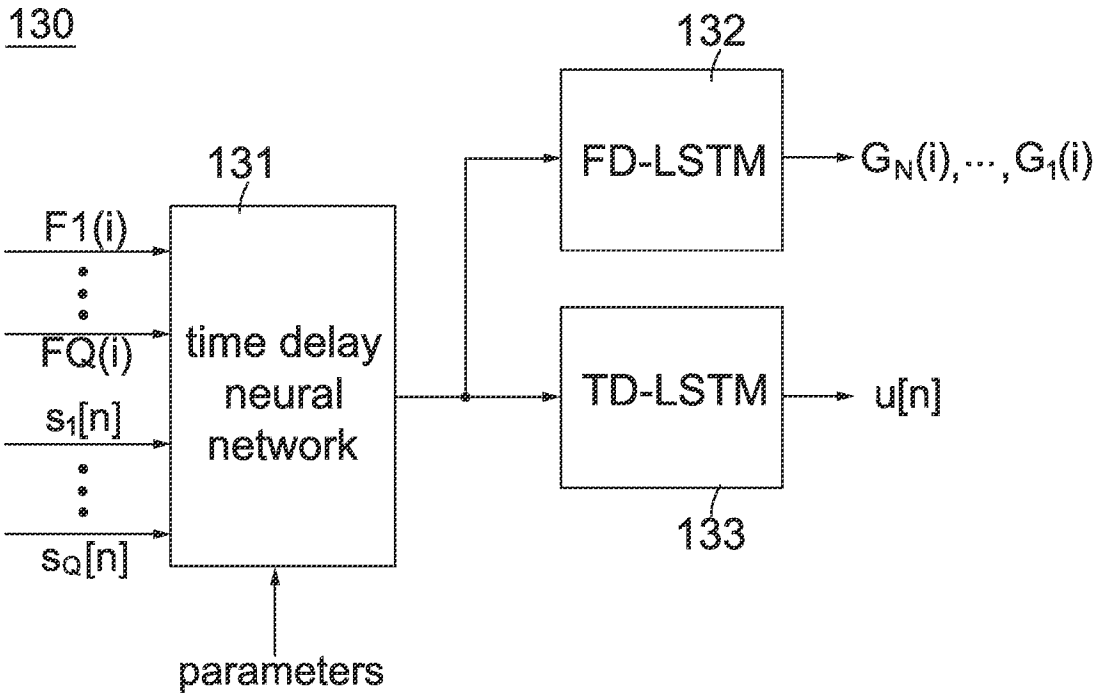
FIG. 3 is a schematic diagram of an end-to-end neural network 130 according to an embodiment of the invention.

FIG. 3 is a schematic diagram of an end-to-end neural network 130 according to an embodiment of the invention. In a preferred embodiment, referring to FIG. 3, the end-to-end neural network 130 includes a time delay neural network (TDNN) 131, a frequency-domain long short-term memory (FD-LSTM) network 132 and a time-domain long short-term memory (TD-LSTM) network 133. In this embodiment, the TDNN 131 with "shift-invariance" property is used to process time series audio data. The significance of shift invariance is that it avoids the difficulties of automatic segmentation of the speech signal to be recognized by the uses of layers of shifting time-windows. The LSTM networks 132~133 have feedback connections and thus are well-suited to processing and making predictions based on time series audio data, since there can be lags of unknown duration between important events in a time series. Besides, the TDNN 131 is capable of extracting short-term (e.g., less than 100 ms) audio features such as magnitudes, phases, pitches and non-stationary sounds, while the LSTM networks 132~133 are capable of extracting long-term (e.g., ranging from 100 ms to 3 seconds) audio features such as scenes, and sounds correlated with the scenes. Please be noted that the above embodiment (TDNN 131 with FD-LSTM network 132 and TD-LSTM network 133) is provided by way of example and not limitations of the invention. In actual implementations, any other type of neural networks can be used and this also falls in the scope of the invention.

According to the input parameters, the end-to-end neural network 130 receives the Q current spectral representations F1(*i*)~FQ(i) and audio data of the current frames i of Q time-domain input streams $s_1[n]$~$s_Q[n]$ in parallel, performs ANC function and advanced audio signal processing and generates one frequency-domain compensation mask stream (including N mask values $G_1(i)$~$G_N(i)$) corresponding to N frequency bands and audio data of the current frame i of one time-domain output sample stream u[n]. Here, the advanced audio signal processing includes, without limitations, noise suppression, AFC, sound amplification, alarm-preserving, environmental classification, direction of arrival (DOA) and beamforming, speech separation and wearing detection. For purpose of clarity and ease of description, the following embodiments are described with the advanced audio signal processing only including noise suppression, AFC and sound amplification. However, it should be understood that the embodiments of the the end-to-end neural network 130 are not so limited, but are generally applicable to other types of audio signal processing, such as environmental classification, direction of arrival (DOA) and beamforming, speech separation and wearing detection.

For the sound amplification function, the input parameters for the end-to-end neural network 130 include, with limitations, magnitude gains, a maximum output power value of the signal z[n] (i.e., the output of inverse STFT 154) and a set of N modification gains $g_1$~$g_N$ corresponding to N mask values $G_1(i)$~$G_N(i)$, where the N modification gains $g_1$~$g_N$ are used to modify the waveform of the N mask values $G_1(i)$~$G_N(i)$. For the noise suppression, AFC and ANC functions, the input parameters for the end-to-end neural network 130 include, with limitations, level or strength of suppression. For the noise suppression function, the input data for a first set of labeled training examples are constructed artificially by adding various noise to clean speech data, and the ground truth (or labeled output) for each example in the first set of labeled training examples requires a frequency-domain compensation mask stream (including N mask values $G_1(i)$~$G_N(i)$) for corresponding clean speech data. For the sound amplification function, the input data for a second set of labeled training examples are weak speech data, and the ground truth for each example in the second set of labeled training examples requires a frequency-domain compensation mask stream (including N mask values $G_1(i)$~$G_N(i)$) for corresponding amplified speech data based on corresponding input parameters (e.g., including a corresponding magnitude gain, a corresponding maximum output power value of the signal z[n] and a corresponding set of N modification gains $g_1$~$g_N$). For the AFC function, the input data for a third set of labeled training examples are constructed artificially by adding various feedback interference data to clean speech data, and the ground truth for each example in the third set of labeled training examples requires a frequency-domain compensation mask stream (including N mask values $G_1(i)$~$G_N(i)$) for corresponding clean speech data. For the ANC function, the input data for a fourth set of labeled training examples are constructed artificially by adding the direct sound data to clean speech data, the ground truth for each example in the fourth set of labeled training examples requires N sample values of the time-domain denoised audio data u[n] for corresponding clean speech data. For speech data, a wide range of people's speech is collected, such as people of different genders, different ages, different races and different language families. For noise data, various sources of noise are used, including markets, computer fans, crowd, car, airplane, construction, etc. For the feedback interference data, interference data at various coupling levels between the loudspeaker 163 and the microphones 11~1Q are collected. For the direct sound data, the sound from the inputs of the hearing devices to the user eardrums among a wide range of users are collected. During the process of artificially constructing the input data, each of the noise data, the feedback interference data and the direct sound data is mixed at different levels with the clean speech data to produce a wide range of SNRs for the four sets of labeled training examples.

In a training phase, the TDNN 131 and the FD-LSTM network 132 are jointly trained with the first, the second and the third sets of labeled training examples, each labeled as a corresponding frequency-domain compensation mask stream (including N mask values $G_1(i)$~$G_N(i)$); the TDNN 131 and the TD-LSTM network 133 are jointly trained with the fourth set of labeled training examples, each labeled as N corresponding time-domain audio sample values. When trained, the TDNN 131 and the FD-LSTM network 132 can process new unlabeled audio data, for example audio feature vectors, to generate N corresponding frequency-domain mask values $G_1(i)$~$G_N(i)$ for the N frequency bands while the TDNN 131 and the TD-LSTM network 133 can process new unlabeled audio data, for example audio feature vectors, to generate N corresponding time-domain audio sample values for the current frame i of the signal u[n]. In one embodiment, the N mask values $G_1(i)$~$G_N(i)$ are N band gains (being bounded between Th1 and Th2; Th1<Th2) corresponding to the N frequency bands in the current spectral representations F1(*i*)~FQ(i). Thus, if any band gain value $G_k(i)$ gets close to Th1, it indicates the signal on the corresponding frequency band k is noise-dominant; if any band gain value $G_k(i)$ gets close to Th2, it indicates the signal on the corresponding frequency band k is speech-dominant. When the end-to-end neural network 130 is trained, the higher the SNR value in a frequency band k is, the higher the band gain value $G_k(i)$ in the frequency-domain compensation mask stream becomes.

In brief, the low latency of the end-to-end neural network 130 between the time-domain input signals $s_1[n]$~$s_Q[n]$ and the responsive time-domain output signal u[n] fully satisfies the ANC requirements (i.e., less than 50 μs). In addition, the end-to-end neural network 130 manipulates the input current spectral representations F1(*i*)~FQ(i) in frequency domain to achieve the goals of noise suppression, AFC and sound amplification, thus greatly improving the audio quality. Thus, the framework of the end-to-end neural network 130 integrates and exploits cross domain audio features by leveraging audio signals in both time domain and frequency domain to improve hearing aid performance.

Figure 4:
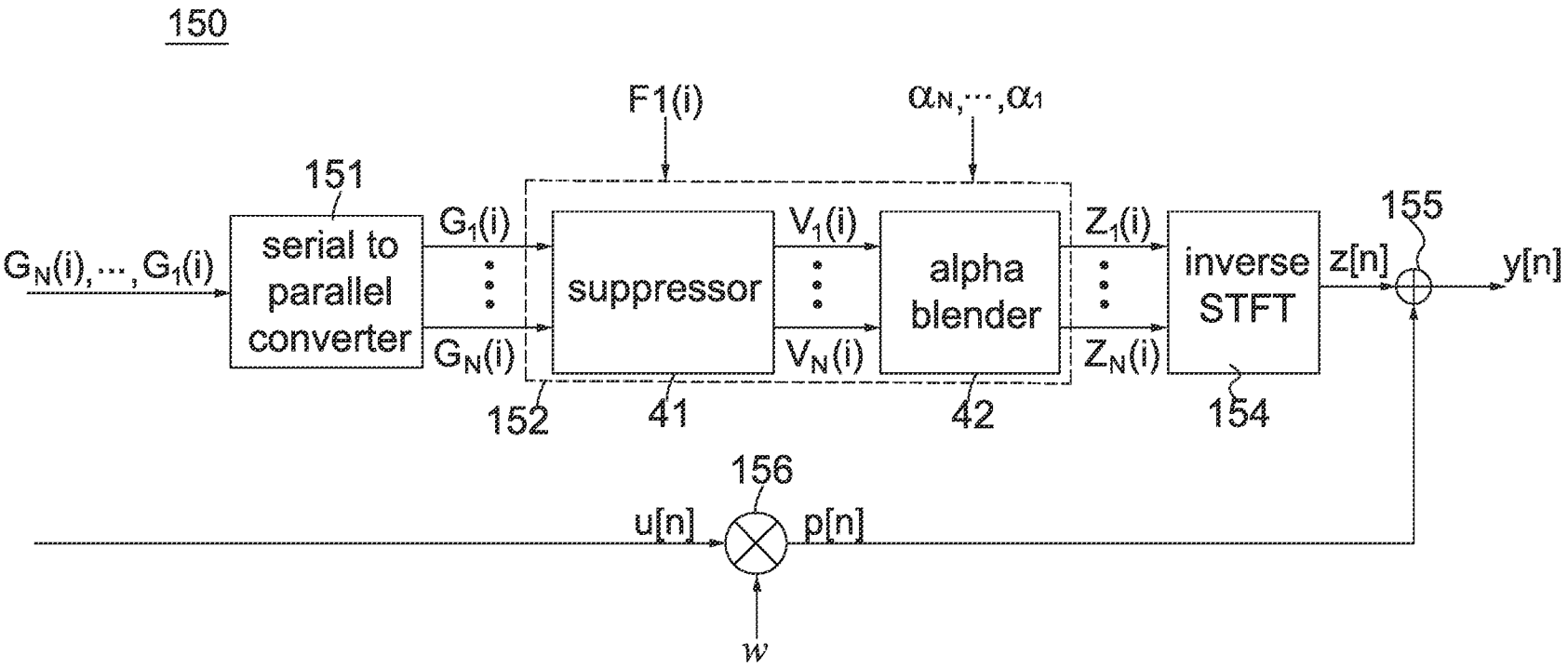
FIG. 4 is a schematic diagram of the post-processing unit 150 according to an embodiment of the invention.
Figure 5:
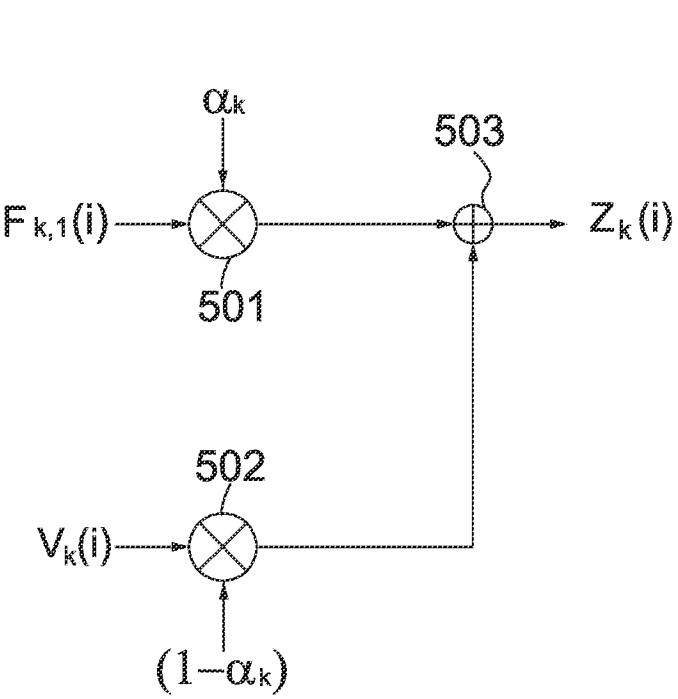
FIG. 5 is a schematic diagram of the blending unit 42*k* according to an embodiment of the invention.

FIG. 4 is a schematic diagram of the post-processing unit 150 according to an embodiment of the invention. Referring to FIG. 4, the post-processing unit 150 includes a serial-to-parallel converter (SPC) 151, a compensation unit 152, an inverse STFT block 154, an adder 155 and a multiplier 156. The compensation unit 152 includes a suppressor 41 and an alpha blender 42. The SPC 151 is configured to convert the complex-valued data stream ($G_1(i)$~$G_N(i)$) into N parallel complex-valued data and simultaneously send the N parallel complex-valued data to the suppressor 41. The suppressor 41 includes N multipliers (not shown) that respectively multiply the N mask values ($G_1(i)$~$G_N(i)$) by their respective complex-valued data ($F_{1,1}(i)$~$F_{N,1}(i)$) of the main spectral representation F1(*i*) to obtain N product values ($V_1(i)$~$V_N(i)$), i.e., $V_k(i)=G_k(i)\times F_{k,1}(i)$. The alpha blender 42 includes N blending units 42*k* that operate in parallel, where 1<=k<=N. FIG. 5 is a schematic diagram of a blending unit 42*k* according to an embodiment of the invention. Each blending unit 42*k* includes two multipliers 501~502 and one adder 503. Each blending unit 42*k* is configured to compute complex-valued data: $Z_k(i)=F_{k,1}(i)\times\alpha_k+V_k(i)\times(1-\alpha_k)$, where $\alpha_k$ denotes a blending factor of kth frequency band for adjusting the level (or strength) of noise suppression and acoustic feedback cancellation. Then, the inverse STFT block 154 transforms the complex-valued data ($Z_1(i)$~$Z_N(i)$) in frequency domain into audio data of the current frame i of the audio signal z[n] in time domain. In addition, the multiplier 156 sequentially multiplies each sample in the current frame i of the digital audio signal u[n] by w to obtain audio data in the current frame i of an audio signal p[n], where w denotes a weight for adjusting the ANC level. Afterward, the adder 155 sequentially adds two corresponding samples in the current frames i of the two signals z[n] and p[n] to produce audio data in the current frame i of a sum signal y[n]. Next, the DAC 161 converts the digital audio signal y[n] into an analog audio signal Y and then the amplifier 162 amplifies the analog audio signal Y to produce an amplified signal SA. Finally, the loudspeaker 163 converts the amplified signal SA into a sound pressure signal in an ear canal of the user.

The above embodiments and functional operations can be implemented in digital electronic circuitry, in tangibly-embodied computer software or firmware, in computer hardware, including the structures disclosed in this specification and their structural equivalents, or in combinations of one or more of them. The operations and logic flows described in FIGS. 1-5 can be performed by one or more programmable computers executing one or more computer programs to perform their functions, or by special purpose logic circuitry, e.g., an FPGA (field programmable gate array) or an ASIC (application-specific integrated circuit). Computers suitable for the execution of the one or more computer programs include, by way of example, can be based on general or special purpose microprocessors or both, or any other kind of central processing unit. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks.

While certain exemplary embodiments have been described and shown in the accompanying drawings, it is to be understood that such embodiments are merely illustrative of and not restrictive on the broad invention, and that this invention should not be limited to the specific construction and arrangement shown and described, since various other modifications may occur to those ordinarily skilled in the art.

What is claimed is:

1. A hearing device, comprising:

a main microphone that generates a main audio signal;

M auxiliary microphones that generate M auxiliary audio signals;

a transform circuit that respectively transforms multiple first sample values in current frames of the main audio signal and the M auxiliary audio signals into a main spectral representation and M auxiliary spectral representations;

at least one processor;

at least one storage media including instructions operable to be executed by the at least one processor to perform a set of operations comprising:

performing active noise cancellation (ANC) operations over the multiple first sample values using an end-to-end neural network to generate multiple second sample values; and performing audio signal processing operations over the main spectral representation and the M auxiliary spectral representations using the end-to-end neural network to generate a compensation mask; and a post-processing circuit that modifies the main spectral representation with the compensation mask to generate a compensated spectral representation, and that generates an output audio signal according to the second sample values and the compensated spectral representation, where M>0.

2. The hearing device according to claim 1, wherein the compensation mask comprises multiple frequency band gains, each indicating its corresponding frequency band is either speech-dominant or noise-dominant.

3. The hearing device according to claim 1, wherein the end-to-end neural network is a deep neural network (DNN), a convolutional neural network (CNN), a recurrent neural network (RNN), a time delay neural network (TDNN) or a combination thereof.

4. The hearing device according to claim 1, wherein the end-to-end neural network comprises:

a time delay neural network (TDNN);

a first long short-term memory (LSTM) network coupled to the output of the TDNN; and a second LSTM network coupled to the output of the TDNN;

wherein the TDNN and the first LSTM network are jointly trained to perform the ANC operations over the first sample values based on a first parameter to generate the second sample values; and wherein the TDNN and the second LSTM network are jointly trained to perform the audio signal processing operations over the main spectral representation and the M auxiliary spectral representations based on a second parameter to generate the compensation mask.

5. The hearing device according to claim 4, wherein the first parameter is a first strength of suppression, wherein if the audio signal processing operations comprise at least one of noise suppression and acoustic feedback cancellation (AFC), the second parameter is a second strength of suppression, and wherein if the audio signal processing operations comprise sound amplification, the second parameter is at least one of a magnitude gain, a maximum output power value of a time-domain signal associated with the compensated spectral representation and a set of modification gains corresponding to the compensation mask.

6. The hearing device according to claim 1, wherein the audio signal processing operations comprise at least one of noise suppression, acoustic feedback cancellation (AFC), and sound amplification.

7. The hearing device according to claim 1, wherein the post-processing circuit comprises:

a suppressor configured to respectively multiply multiple first components in the main spectral representation by respective mask values in the compensation mask to generate multiple second components in the compensated spectral representation;

an inverse transformer coupled to the output of the suppressor that inverse transforms a specified spectral representation associated with the compensated spectral representation into multiple third sample values; and an adder, a first input terminal of the adder being coupled to the output of the inverse transformer, a second input terminal of the adder being coupled to the at least one processor, wherein the adder sequentially adds each third sample value and a corresponding fourth sample value associated with the second sample values to generate a corresponding fifth sample value in the current frame of the output audio signal.

8. The hearing device according to claim 7, wherein the post-processing circuit further comprises:

a multiplier coupled between the at least one processor and the second input terminal of the adder that sequentially multiplies each second sample value by an ANC weight to generate the corresponding fourth sample value.

9. The hearing device according to claim 7, wherein the post-processing circuit further comprises:

a blender coupled between the suppressor and the inverse transformer and that respectively blends the first components in the main spectral representation and their respective second components in the compensated spectral representation according to blending weights corresponding to multiple frequency bands of the main spectral representation to generate the specified spectral representation.

10. The hearing device according to claim 1, further comprising:

a digital to analog converter that converts the output audio signal into an analog audio signal; and a loudspeaker that converts the analog audio signal into a sound pressure signal.

11. An audio processing method applicable to a hearing device, comprising:

respectively transforming first sample values in current frames of a main audio signal and M auxiliary audio signals from a main microphone and M auxiliary microphones of the hearing device into a main spectral representation and M auxiliary spectral representations, where M>0;

performing active noise cancellation (ANC) operations over the first sample values using an end-to-end neural network to obtain multiple second sample values;

performing audio signal processing operations over the main spectral representation and the M auxiliary spectral representations using the end-to-end neural network to obtain a compensation mask;

modifying the main spectral representation with the compensation mask to obtain a compensated spectral representation; and obtaining an output audio signal according to the second sample values and the compensated spectral representation.

12. The method according to claim 11, wherein the compensation mask comprises multiple frequency band gains, each indicating its corresponding frequency band is either speech-dominant or noise-dominant.

13. The method according to claim 11, wherein the end-to-end neural network is a deep neural network (DNN), a convolutional neural network (CNN), a recurrent neural network (RNN), a time delay neural network (TDNN) or a combination thereof.

14. The method according to claim 11, wherein the audio signal processing operations comprise at least one of noise suppression, acoustic feedback cancellation (AFC), and sound amplification.

15. The method according to claim 11, wherein the end-to-end neural network comprises a time delay neural network (TDNN), a first long short-term memory (LSTM) network and a second LSTM network, wherein the TDNN and the first LSTM network are jointly trained to perform the ANC operations over the first sample values based on a first parameter to generate the second sample values, and wherein the TDNN and the second LSTM network are jointly trained to perform the audio signal processing operations over the main spectral representation and the M auxiliary spectral representations based on a second parameter to generate the compensation mask.

16. The method according to claim 15, wherein the first parameter is a first strength of suppression, wherein if the audio signal processing operations comprise at least one of noise suppression and acoustic feedback cancellation (AFC), the second parameter is a second strength of suppression, and wherein if the audio signal processing operations comprise sound amplification, the second parameter is at least one of a magnitude gain, a maximum output power value of a time-domain signal associated with the compensated spectral representation and a set of modification gains corresponding to the compensation mask.

17. The method according to claim 11, wherein the step of obtaining the output signal comprises:

respectively multiplying multiple first components in the main spectral representation by respective mask values of the compensation mask to obtain multiple second components in the compensated spectral representation;

inverse transforming a specified spectral representation associated with the compensated spectral representation into third sample values; and sequentially adding each third sample value and a corresponding fourth sample value associated with the second sample values to generate a corresponding fifth sample value in the current frame of the output audio signal.

18. The method according to claim 17, wherein the step of obtaining the output signal further comprises:

sequentially multiplying each second sample value by an ANC weight to obtain the corresponding fourth sample value prior to the step of sequentially adding and after the step of performing the ANC operations.

19. The method according to claim 17, wherein the step of obtaining the output signal further comprises:

respectively blending the first components in the main spectral representation and their respective second components in the compensated spectral representation according to blending weights corresponding to multiple frequency bands of the main spectral representation to obtain the specified spectral representation prior to the step of inverse transforming and after the step of respectively multiplying the multiple first components.

20. The method according to claim 11, further comprising:

converting the output audio signal into an analog audio signal; and converting the analog audio signal by a loudspeaker into a sound pressure signal.

* * * * *